US010806254B2

(12) United States Patent
Elliott

(10) Patent No.: US 10,806,254 B2
(45) Date of Patent: Oct. 20, 2020

(54) CLEVER CLOSET RODS

(71) Applicant: Bradley Chad Elliott, Cincinnati, OH (US)

(72) Inventor: Bradley Chad Elliott, Cincinnati, OH (US)

(73) Assignee: Bradley C Elliott, Cincinnati, OH (US)

( * ) Notice: Subject to any disclaimer, the term of this patent is extended or adjusted under 35 U.S.C. 154(b) by 0 days.

(21) Appl. No.: 16/411,016

(22) Filed: May 13, 2019

(65) Prior Publication Data

US 2020/0008573 A1 Jan. 9, 2020

Related U.S. Application Data

(60) Provisional application No. 62/671,557, filed on May 15, 2018.

(51) Int. Cl.
*A47B 61/02* (2006.01)

(52) U.S. Cl.
CPC ..... *A47B 61/02* (2013.01)

(58) Field of Classification Search
CPC ..... A47B 61/00; A47B 61/003; A47B 61/02; A47B 61/04; A47B 61/06
USPC .... 211/85.3, 96, 97, 99, 104, 110, 111, 115, 211/116, 163, 165, 167, 196, 205
See application file for complete search history.

(56) References Cited

U.S. PATENT DOCUMENTS

| | | | | |
|---|---|---|---|---|
| 1,278,790 | A * | 9/1918 | Thunell | 312/324 |
| 2,095,900 | A * | 10/1937 | Albert | A47G 25/74 211/85.3 |
| 4,611,721 | A * | 9/1986 | Heckaman | A47G 25/746 211/100 |
| 5,143,231 | A * | 9/1992 | Chang | A47B 61/003 211/168 |
| 7,874,437 | B2 * | 1/2011 | Jones | A47B 61/003 211/105.1 |
| 8,540,087 | B1 * | 9/2013 | Skaer | A47G 25/0685 211/100 |
| 9,854,907 | B2 * | 1/2018 | Best | A47B 61/003 |
| 10,111,543 | B2 * | 10/2018 | Terragni | A47G 25/0685 |
| 10,299,569 | B1 * | 5/2019 | Taylor | A45D 44/06 |
| 2007/0272642 | A1 * | 11/2007 | Baptiste | A47B 43/00 211/201 |
| 2013/0126453 | A1 * | 5/2013 | Flickinger | A47F 7/00 211/85.3 |
| 2014/0103000 | A1 * | 4/2014 | Avissar | A47G 25/0614 211/85.3 |

* cited by examiner

*Primary Examiner* — Joshua E Rodden

(57) ABSTRACT

A rod mounted on a bracket designed to be attached to one of a jamb of a closet, on a substantial vertical center post, or other substantial vertical support where access to space behind is desired, as well as the ability to fully access a clothing, or other items that may be supported by the rod by moving the rod out of the space where access is desired. With more than a single hinge point the support rod will move in, and out of the space that it occupies allowing access to otherwise wasted space that a normal support rod would occupy. The rod is able to then allow the user to access both the space by moving the rod, and supported items out of the way, and allowing the user to access the full array of items supported by the rod with ease.

20 Claims, 6 Drawing Sheets

CLEVER CLOSET RODS

BACKGROUND OF THE INVENTION

The utility model discloses clothes hanging, or storage rod for use in a cubby space, wardrobe, or closet where when properly mounted on a vertical doorjamb, center post, or other substantial vertical support will allow the clothing rod, or storage rod to completely move in, and out of the closet, cubby space, or wardrobe taking with it all it encompasses, and allowing access to otherwise wasted space where a normal clothing, or support rod would remain stationary. There are no prior versions of this utility model on the market where the contents dependent on the system are completely, and easily removed from the space transported via hinge systems and affixed to a single suitable mounting surface. Prior systems afford storage of clothing, and do not like this utility model allow complete access to both sides of the items dependent on the utility rod. The normal systems do not allow for extra storage space in the room occupied by a stationary system.

Unfortunately, there are several instances where closet rods, or storage rods mounted in the conventional manner pose a great restriction to the space that they occupy, and often are difficult to access both items on the rod, and space behind that may be wasted. Another present utility invention of some pull down closet rods allow the user to store the closet rod at an elevated height, and pull it down when in need. This also fails to operate in a similar manner to the presented utility rod in this application since it fails to take the clothing in, and completely out of the closet from a single point, and does not allow for extra room behind for shelving since its stationary mounting points remain fixed. Current applications include spanning sections of rod used to store items, and clothing such as U.S. Pat. No. 3,891,091A which is a rectangular closet rod that spans the space that it occupies, or U.S. Pat. No. 4,643,318A which is a safety closet system that breaks away with yieldable predetermined strain. In both applications the rod is stationary, and unable to swivel from a single point attached to wall, door jamb, or other substantial vertical mounting point in a space where complete access may be required. Therefore, it is an object of the present utility invention to provide a movable, swiveling, or articulating method of storage for cloths, or items which dependent on the mounted rod can be moved, or transported in, and completely out of a space. This utility storage rod for clothing, and other supported items able to move completely out of the way allows the access to the complete space to the sides of the space that otherwise would remain inaccessible, as well as a method of accessing that storage while remaining a usable clothing, or storage rod. The utility rod also allows access to the complete array of items that dependent on it, and are able to be moved out of a space in a quick, and orderly manner. The utility system being easy to install, and effective always within adequate operational space provides a suitable, and enhanced way of storing items, and clothing in a closet, cubby space, or other desired application when adequately mounted on a suitable vertical structure. Instead of Steel, aluminum, plastic, and other material may be used to form the rod, and separate parts pertaining to the structure or mounting of the invention. The rod may be square, rectangular, or polygonal, and is not limited to any particular form. The bracket may also be made from various materials and is not limited to any particular medium. For example, the wan bracket could be made of aluminum, and produced similarly with holes for mounting in a suitable way.

BRIEF SUMMARY OF THE INVENTION

The Utility closet rod, or storage rod is a storage system that mounts to a stationary point in a closet cubby space, or other applicable space that allows the user to completely move, or swivel the contents dependent on the system to another point completely away from the space that the user may desire to access from the single stationary point via hinging mechanism. With adequate space the user may gain access to otherwise impeded space for example a closet with extra depth, or shelving that otherwise may be impeded by a stationary closet rod, or other mobile closet rod would. When mounted on a suitable vertical structure such as a door jamb with lag bolts, and able to swivel from a single point hinging from a single point the utility closet rod will be able to come out, and around the supporting structure for the user to gain access to prior described space, and the full range of clothing. When installed the closet rod will grant the user a way to remove everything out of the closet that is supported on the rod in seconds, and grants the user space to walk in to space prior occupied by clothing, or other items like shoe racks fitted to the rod. The utility clothing rod will help elderly, and other people who may be impeded easier access to clothing. The rod may be supported via wall bracket, or other stationary post in this case an adjustable center post, if centrally located multiple rods may be used, and at any desired height. The utility closet rod is made from, and not limited to steel, and is fitted with caps, and bumpers for safety.

BRIEF DESCRIPTION OF THE SEVERAL VIEWS OF THE DRAWING

Key.

A. Top Bracket
B. Perforated tube
C. Bottom of post
D. Hinge Bracket
E. ½" Bolt/Nut
F. 718 Bolt/Nut
G. Oil Infused Bushings
H. Dom Pipe
I. Wish Bone Arm
J. Wall Bracket
K. Standard Closet Arm
L. Rubber Bumper
M. Rubber Rod
N. ⅜" Bolt/Nut
O. 90° Closet Arm
P. End Cap FIG. 1—Adjustable center post A, B, and C Made out of, and not limited to a 2" square perforated tube 4' long B with holes every 1" on center allowing 1" adjustments for D common hinge bracket modified with 2 corresponding holes for use in conjunction with adjustable center post if applicable bolted through brackets with F 7/16" Bolt. The top of post is fixed by A bracket made out of, and not limited to a two inch strap approximately 12" long with staggered ⅜" holes, and center mounted angle 1¾"×1¾"×2½" allowing the post to fit nicely against the bracket with angle inside holding the top of the post stationary, and fastened with ¼" lag bolts. The bottom of the adjustable center post made out of, and not limited to 1¾"×1¾" tube 3' long capped at the bottom to allow clearance of possible threshold, and a 4×4 plate welded on the bottom with staggered holes offset, and drilled 3/16" to allow to be fixed firmly to the floor with a 7/16" hole drilled on ether side 2"

down. Allowing the middle section of the post B to act telescopic, and fit around the bottom section of post, and be through bolted at one-inch increments with F 7/16" bolt. The top of post able to be variable within that inch of adjustment.

Figure 2A:
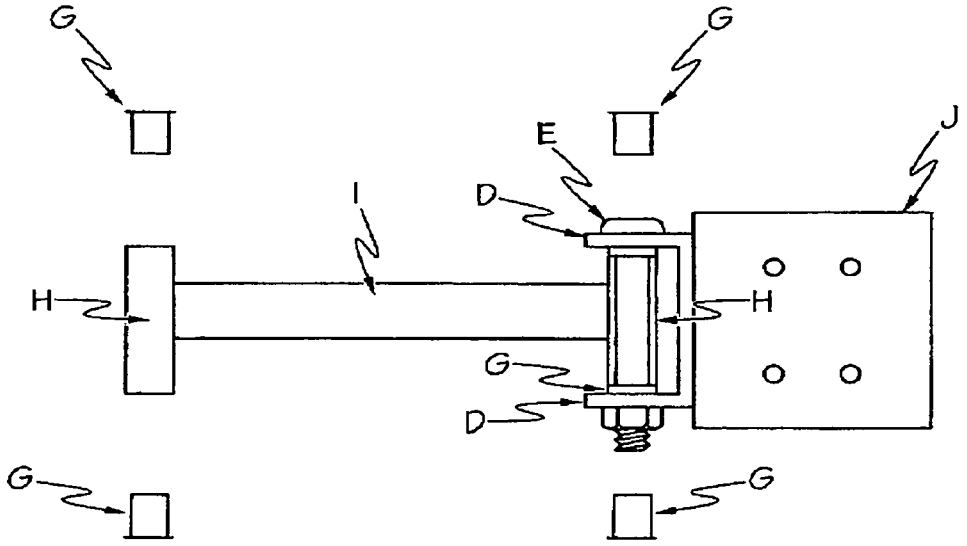
Figure 2B:
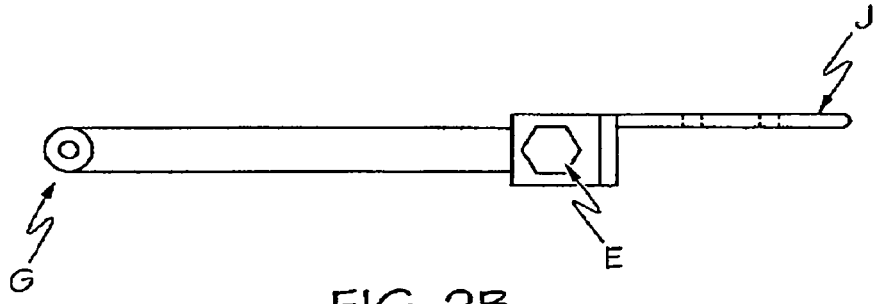

FIG. 2A/FIG. 2B—Wall Bracket J, and Wishbone Arm I

The wall bracket J is made out of, but not limited to a ¼" thick 5×2", angle 5" long with a series of 5/16 holes dried into the five inch side, and one hole on the 2" side centered to hold the bracket for easy mounting all ¼ lag screws to fix the bracket to doorjambs, or similar substantial vertical mounting surface. The plate J also has a bracket made out of, and not limited to 2" 3/16 strap bent with ears spaced 3⅜ apart, and holes centered 1" on the ears allowing room for the dom hinge pipe welded onto the wishbone arm, and bushings to fit between the bracket ears, and bolted through with E ½" bolt approximately 5" bolt, and thus creating a smooth hinge point for the system.

The wishbone arm made out of, and not limited to a piece of 1" schedule 40 pipe with two ends 1"dom 3" long pipe welded on either end spaced 9½" on center fitted with oil Infused bushings, and in conjunction with both wall bracket J, and common hinge bracket D allows for a smooth hinge point when through bolted with E ½" bolt approximately 5" long partially threaded.

Figure 3A:
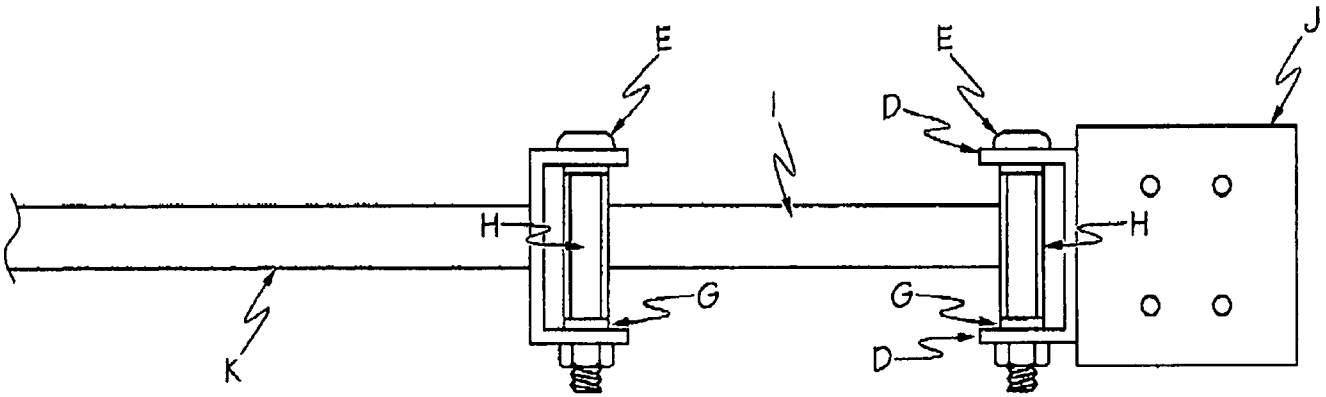
Figure 3B:
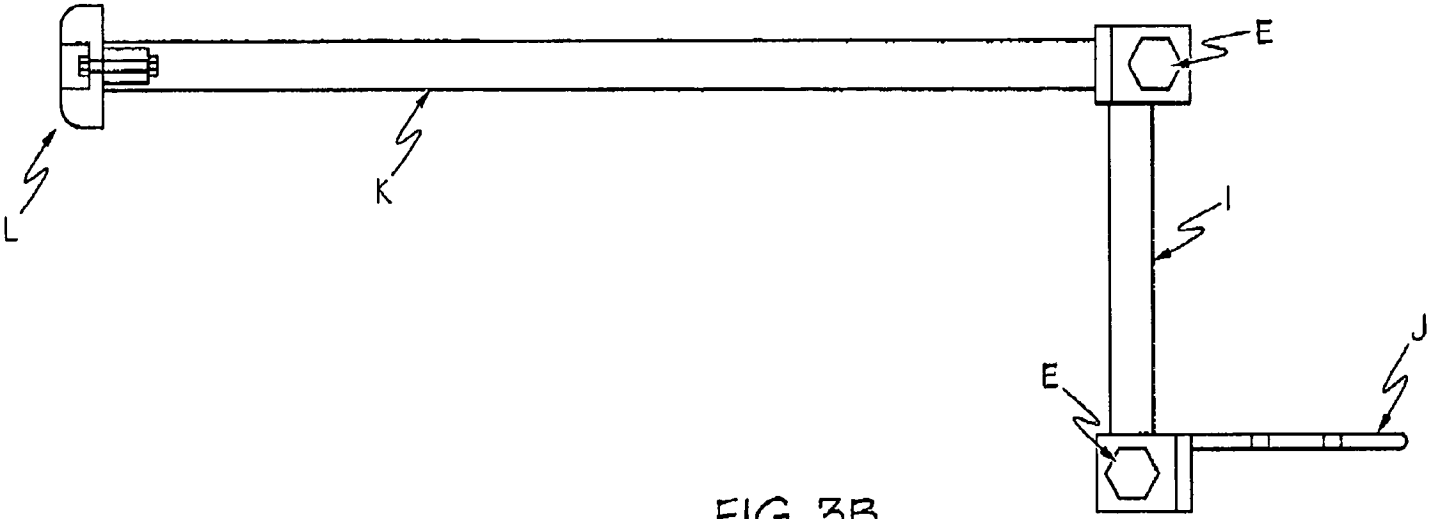

FIG. 3A/FIG. 3B—Standard Closet Arm K

Figure 1:
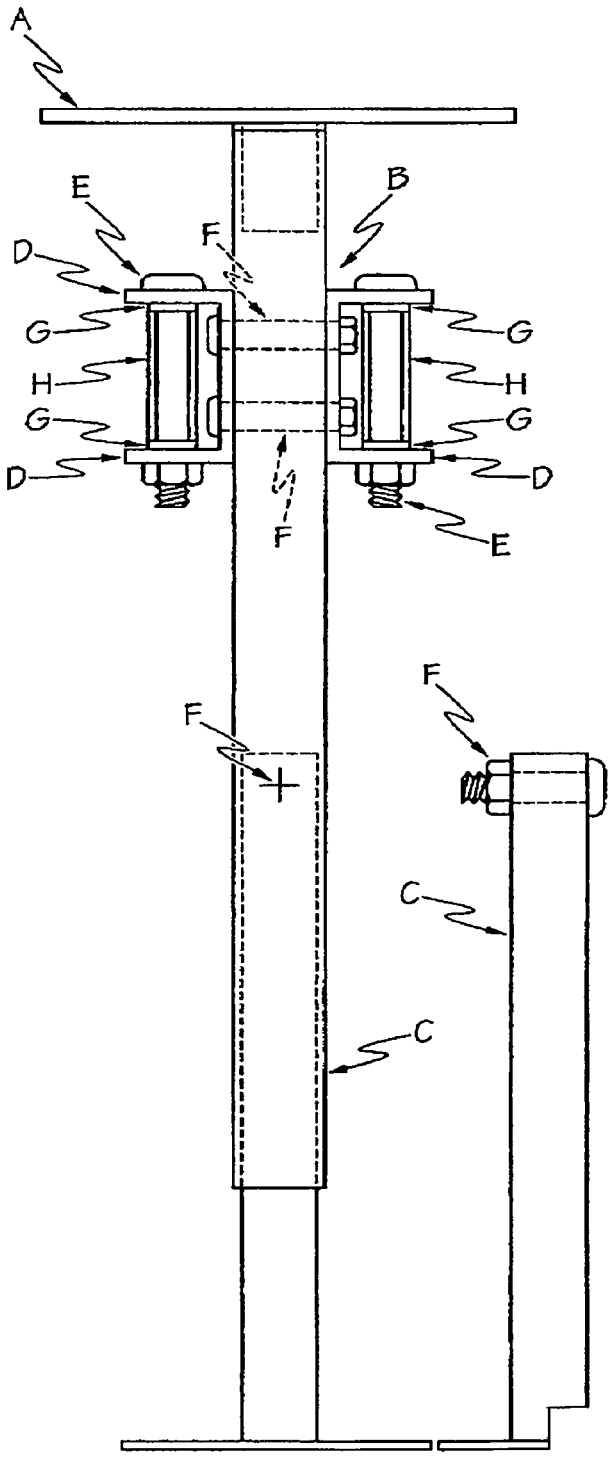
Figure 3C:
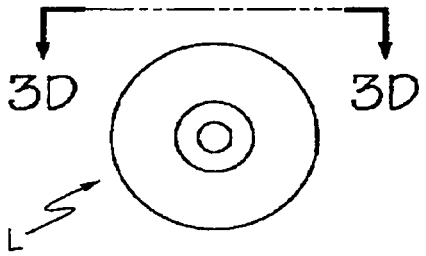
Figure 3D:
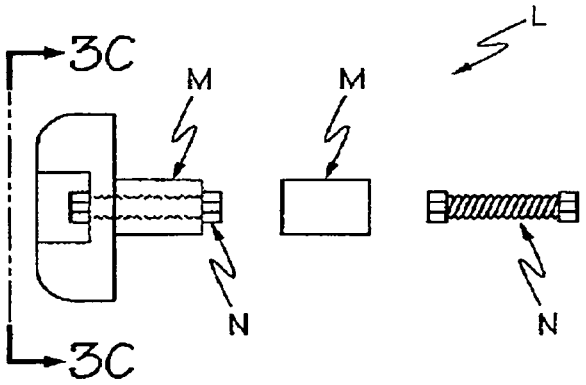
Figure 4A:
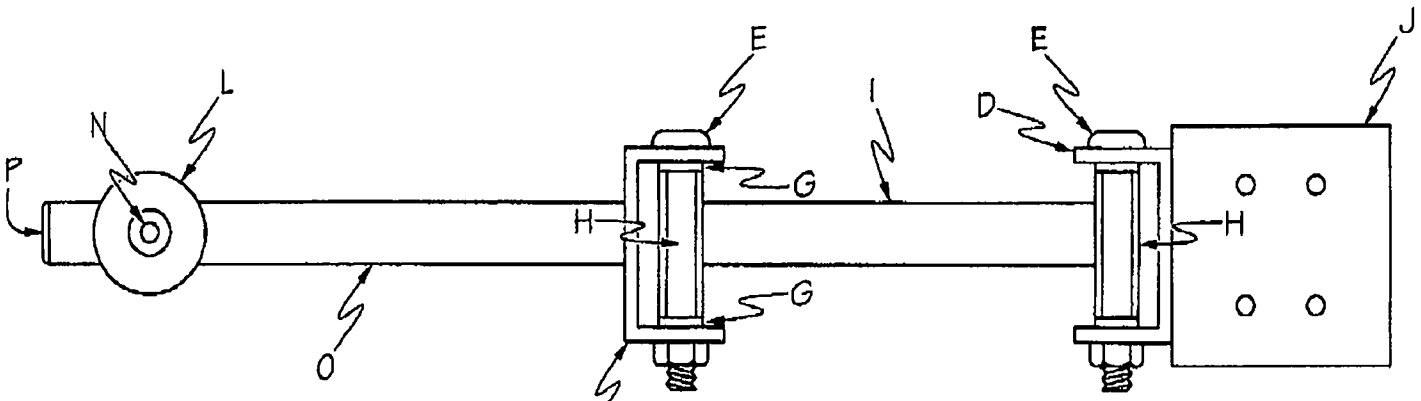
Figure 4B:
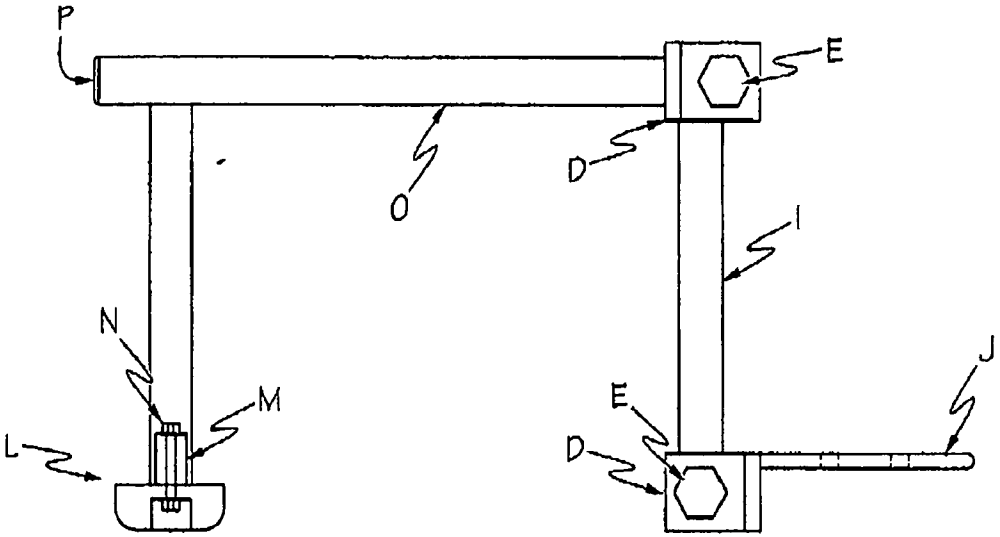
Figure 5A:
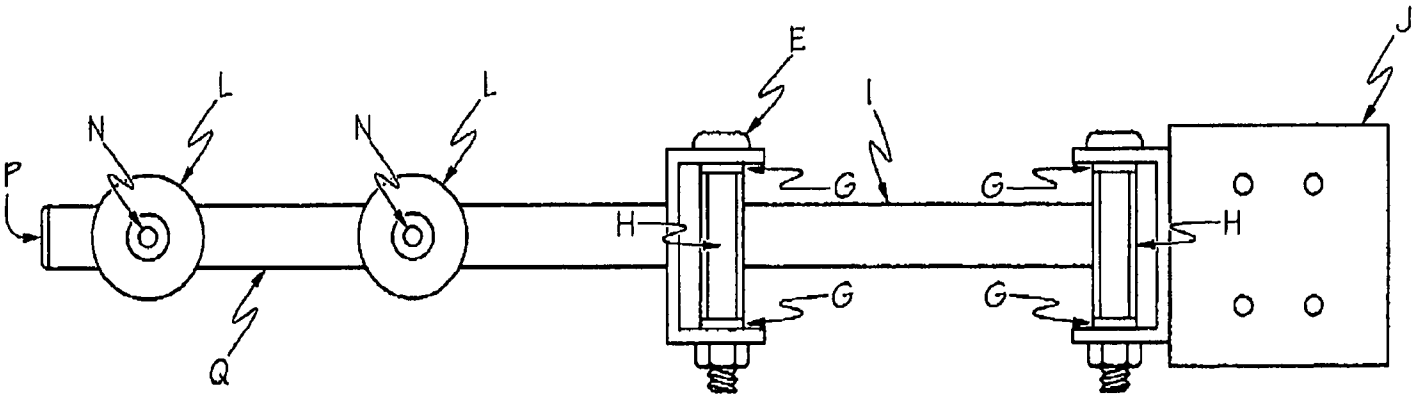
Figure 5B:
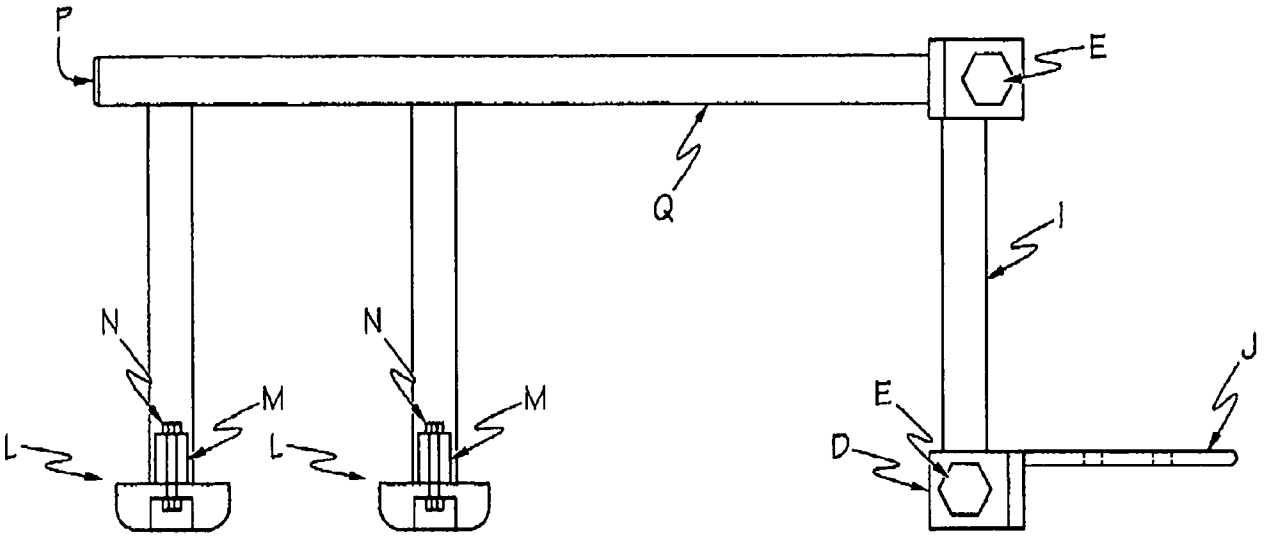

Made out of, and not limited to a common D bracket welded to a piece of schedule 40 1" pipe trimmed to the desired length for drawing purposes 32" acting like a normal clothing rod used in conjunction with the wishbone arm I, and vertical mounted center post shown in FIG. 1, or wall bracket shown in FIG. 2A/FIG. 2B, J allowing the system to completely move it, and its contents completely out of the cubby space, cabinet, or closet FIG. 3C/FIG. 3D, common rubber bumper assembly L, M, and N, when fitted onto the standard closet arm as shown in FIG. 3A/3B, the 90° closet arm shown in FIG. 4A/4B, and the double 90° closet arm shown in FIG. 5A/5B creates a protective bumper for the end of the closet arms when rotating outward.

FIG. 4A/4B—90° Closet Arm O

Made out of, and not limited to a common D bracket welded to a 11" piece of schedule 40 1" pipe capped on the end, and a 9" piece of 1" schedule 40 welded to the pipe fixed to the bracket making a 90° hanging section for clothing hangers, and or other storage items to hang perpendicular to a normal clothing rod capped with end cap P, and fitted with, as shown in FIG. 3C/FIG. 3D, common rubber bumper assembly L, M, and N, on protruding 90° legs. In use in conjunction with the wishbone arm as shown in FIG. 2A/2B, and vertical mounted center post shown in FIG. 1, or wall bracket shown in FIG. 2A/2B, J allowing the system to completely move it, and its contents completely out of the cubby space, cabinet, or closet.

FIG. 5A/5B—Double 90° Closet Arm Q

Made out of, and not limited to a common D bracket welded to a 22½ schedule 40 1" pipe capped on the end, and 90° arms 9' long welded at 7¾, and 13⅞ allowing clothing, hangers, or items stored on hanging rod to be hung side by side perpendicular to a normal clothing rod capped with endcap P. and fitted as shown in FIG. 3C/FIG. 3D with common rubber bumper assembly L, M, and N, on the 90° legs, and in use in conjunction with the wishbone arm as shown in FIG. 2A/2B, and vertical mounted center post shown in FIG. 1, or wag bracket shown in FIG. 2A/2B, J allowing the system to completely move it, and its contents completely out of the cubby space, cabinet, or closet.

DETAILED DESCRIPTION OF THE INVENTION

The Utility closet rods are composed of but not limited to adjoining brackets D bent, and drilled bolted to the adjustable center post, a post made of, and not limited to 2 inch perforated square tube with holes every 1" for adjustments stabilized at the top with A, and B is able to telescope over its base C, a 1¾"×1¾" post with a plate drilled, and welded on the bottom, and capped for possible threshold egress, or J the wall bracket. The D bracket when in use has four holes, two for the intermediate wishbone arm I, also noted in FIG. 2A/2B, and two for use with the adjustable center post as shown in FIG. 1, the D bracket when in use with the wall mount will not have four holes and will only contain two holes on the ears for the wishbone arm letter I and win instead be welded to J an angle 5×2×5 that will contain holes spaced apart for lag bolts to securely fasten the utility closet rod system. The wishbone arm depicted in FIGS. 2A/2B, referenced as I remains consistent and is composed of a pipe with two hinge pipes H welded on each end and made to fit between bracket D as also depicted in FIG. 2A. With through bolts, and nuts E depicted, and G bushings also depicted in FIG. 2A, and the wishbone arm in conjunction with D creates a single hinge point from the stationary mounting point. As shown in FIG. 3A/3B, the standard closet arm is a single piece of steel pipe 32" long fitted with common rubber bumper assembly 1, M, and N, and with bracket like the D bracket depicted in FIG. 1, and FIG. 2A when used in conjunction with the wishbone arm depicted in FIG. 2A/2B, and either the center post, or wall bracket J to create a double hinge system that allows a position of hanging that a normal fixed closet, or utility hanging rod would possess, and retains the ability to completely remove itself, and contents that may be dependent completely out of a cubby space, or closet within seconds. The 90° closet arm is similarly used in conjunction with the wishbone arm I fitted with similar bracket D by welding, and either center post, or wall bracket J creating a double hinge point, and with a perpendicular rod positioned at 10", and protruding out 10". Allows for a perpendicular hanging space that would oppose the run of a normal closet rod. This application allows for more space behind the hanging items to be utilized for shelving, or other reason desired, and retains the same ability as the normal closet, or utility rod to completely evacuate the space that it occupies with the Items dependent on the support of the system within seconds also fitted with common rubber bumper assembly L, M, and N, for safety. The double 90° arm is a utility rod that is made like the single 90° arm depicted in FIG. 4A/4B, with one 90° arm ten inches long spaced at 7¾", and another at 13⅞" protruding out from the pipe O, welded to D bracket allowing the user to hang clothing, or supported items perpendicular to a normal run closet rod at two points 10 inches deep, and allows all items dependent, and its structure to completely move in, and out of the closet, or desired space within seconds.

The present invention has been described by an embodiment using a specific illustration of utility rod, and examples of materials, and construction. It is to be understood that this description is merely to facilitate an understanding of the invention, and is not limiting upon the scope thereof, since other embodiments, modifications and changes will be apparent to those sidled in the art.

The invention claimed is:

1. A clothing or storage rod, the rod comprising:

a wall bracket adapted to be attached to a wall, a doorjamb, or a vertical surface, the wall bracket including a plurality holes configured to receive lag screws to fix the wall bracket to one of the wall, the doorjamb, or the vertical surface;

a first hinge bracket attached to the wall bracket, the first hinge bracket Including a pair of ears;

a wish bone arm in the form of an elongated arm having two dom pipes located at each of first and second ends of the elongated arm, respectively, each dom pipe being vertically oriented perpendicularly to the elongated arm, and each dom pipe being sized to be fitted between each of the pair of ears of the first hinge bracket;

a first bolt attaching the first end of the wish bone arm pivotally to the first hinge bracket by passing through each ear in the first hinge bracket and the dom pipe which is located at the first end of the wish bone arm, and an oil infused bushing located at each end of the first bolt.

2. The clothing or storage rod as described in claim 1, wherein the rod further comprises:

a closet arm having a second hinge bracket attached to a first end of the closet arm, the second hinge bracket pivotally attaching the closet arm to the dom pipe which is located at the second end of the wish bone arm.

3. The clothing or storage rod as described in claim 2, wherein the rod further comprises:

a second end of the closet arm attached to a rubber bumper using a rubber rod and a bolt and nut.

4. The clothing or storage rod as described in claim 2, wherein the rod further comprises:

a second bolt attaching the second end of the wish bone arm pivotally to the second hinge bracket by passing through each of a pair of ears in the second hinge bracket and the dom pipe which is located at the second end of the wish bone arm, and an oil infused bushing located at each end of the second bolt.

5. The clothing or storage rod as described in claim 4, wherein the rod further comprises:

a second end of the closet arm attached to a rubber bumper using a rubber rod and a bolt and nut.

6. The clothing or storage rod as described in claim 2, wherein the rod further comprises:

the closet arm Including at least one additional arm extending perpendicularly from the closet arm.

7. The clothing or storage rod as described in claim 6, wherein the rod further comprises:

wherein the at least one additional arm includes a rubber bumper located at a free end of the at least one additional arm using a rubber rod and a bolt and nut.

8. The clothing or storage rod as described in claim 6, wherein the rod further comprises:

wherein the at least one additional arm extending perpendicularly from the closet arm includes two additional arms extending perpendicularly from the closet arm.

9. The clothing or storage rod as described in claim 8, wherein the rod further comprises:

wherein the two additional arms each include a rubber bumper located at a free end of the two additional arms using a rubber rod and a bolt and nut.

10. A clothing or storage rod, the rod comprising:

an adjustable center post, the adjustable center post including a bottom post, a perforated tube telescopically located on the bottom post and a top bracket located on an end of the perforated tube opposite to a side of the perforated tube which is located on the bottom post;

a first hinge bracket attached to the adjustable center post, the first hinge bracket Including a pair of ears;

a first wish bone arm in the form of an elongated arm having two dom pipes located at each of first and second ends of the elongated arm, respectively, each dom pipe being vertically oriented perpendicularly to the elongated arm, and each dom pipe being sized to be fitted between each of the pair of ears of the first hinge bracket;

a first bolt attaching the first end of the wish bone arm pivotally to the first hinge bracket by passing through each ear in the first hinge bracket and the dom pipe which is located at the first end of the wish bone arm, and an oil infused bushing located at each end of the first bolt.

11. The clothing or storage rod as described in claim 10, wherein the rod further comprises:

the first hinge bracket attached to the adjustable center post by bolts and nuts.

12. The clothing or storage rod as described in claim 11, wherein the rod further comprises:

a second hinge bracket attached to the adjustable center post by the bolts and the nuts, with a second wish bone arm pivotally attached to the second hinge bracket.

13. The clothing or storage rod as described in claim 10, wherein the rod further comprises:

a closet arm having a second hinge bracket attached to a first end of the closet arm, the second hinge bracket pivotally attaching the closet arm to the dom pipe which is located at the second end of the wish bone arm.

14. The clothing or storage rod as described in claim 13, wherein the rod further comprises:

a second end of the closet arm attached to a rubber bumper using a rubber rod and a bolt and nut.

15. The clothing or storage rod as described in claim 13, wherein the rod further comprises:

a second bolt attaching the second end of the wish bone arm pivotally to the second hinge bracket by passing through each of a pair of ears in the second hinge bracket and the dom pipe which is located at the second end of the wish bone arm, and an oil Infused bushing located at each end of the second bolt.

16. The clothing or storage rod as described in claim 15, wherein the rod further comprises:

a second end of the closet arm attached to a rubber bumper using a rubber rod and a bolt and nut.

17. The clothing or storage rod as described in claim 13, wherein the rod further comprises:

the closet arm including at least one additional arm extending perpendicularly from the closet arm.

18. The clothing or storage rod as described in claim 17, wherein the rod further comprises:

wherein the at least one additional arm includes a rubber bumper located at a free end of the at least one additional arm using a rubber rod and a bolt and nut.

19. The clothing or storage rod as described in claim 17, wherein the rod further comprises:

wherein the at least one additional arm extending perpendicularly from the closet arm includes two additional arms extending perpendicularly from the closet arm.

20. The clothing or storage rod as described in claim 19, wherein the rod further comprises:

wherein the two additional arms each include a rubber bumper located at a free end of the two additional arms using a rubber rod and a bolt and nut.

* * * * *